US008141326B2

(12) United States Patent
Wang

(10) Patent No.: US 8,141,326 B2
(45) Date of Patent: Mar. 27, 2012

(54) WATER BALLOON TOOL

(76) Inventor: Chialeh Wang, Cerritos, CA (US)

( * ) Notice: Subject to any disclaimer, the term of this patent is extended or adjusted under 35 U.S.C. 154(b) by 224 days.

(21) Appl. No.: 12/766,419

(22) Filed: Apr. 23, 2010

(65) Prior Publication Data

US 2011/0030847 A1 Feb. 10, 2011

Related U.S. Application Data

(63) Continuation-in-part of application No. 12/537,487, filed on Aug. 7, 2009.

(51) Int. Cl.
*B65B 3/16* (2006.01)
*A63H 27/10* (2006.01)
*D03J 3/00* (2006.01)

(52) U.S. Cl. ..... 53/284.7; 53/79; 141/314; 289/17

(58) Field of Classification Search ..... 53/79, 284.7; 141/314; 289/17, 18.1; 446/220; *A63H 27/10; D03J 3/00*
See application file for complete search history.

(56) References Cited

U.S. PATENT DOCUMENTS

| | | | | | |
|---|---|---|---|---|---|
| 3,161,998 | A | * | 12/1964 | Lennox | 53/79 |
| 3,630,555 | A | * | 12/1971 | Newlin | 289/17 |
| 4,989,906 | A | * | 2/1991 | Peverley | 289/17 |
| 5,016,428 | A | * | 5/1991 | Helling et al. | 53/79 |
| 5,039,142 | A | * | 8/1991 | Muma | 289/17 |
| 5,067,301 | A | * | 11/1991 | Shore | 53/79 |
| 5,121,595 | A | * | 6/1992 | Shore | 53/79 |
| 5,314,217 | A | * | 5/1994 | Place | 289/17 |
| 5,439,199 | A | * | 8/1995 | Briggs et al. | 251/320 |
| 5,568,950 | A | * | 10/1996 | Herren | 289/17 |
| 5,611,578 | A | * | 3/1997 | Angelico, Sr. et al. | 289/17 |
| 5,882,051 | A | * | 3/1999 | Dreger et al. | 289/17 |
| 6,082,785 | A | * | 7/2000 | Morgan et al. | 289/17 |
| 6,325,426 | B1 | * | 12/2001 | Boesl | 289/17 |
| 6,408,902 | B1 | * | 6/2002 | Liau | 141/314 |
| 6,478,057 | B1 | * | 11/2002 | Bearss et al. | 446/220 |
| 6,540,267 | B1 | * | 4/2003 | Rohbock et al. | 289/18.1 |
| 6,851,675 | B1 | * | 2/2005 | Jakubec et al. | 273/355 |
| 6,902,212 | B1 | * | 6/2005 | Mize | 289/17 |
| 7,549,683 | B1 | * | 6/2009 | Sikorcin | 289/17 |
| 2008/0121309 | A1 | * | 5/2008 | Boise et al. | 141/313 |
| 2009/0050835 | A1 | * | 2/2009 | Boise et al. | 251/320 |
| 2010/0038906 | A1 | * | 2/2010 | Herren | 289/17 |

FOREIGN PATENT DOCUMENTS

| | | | | |
|---|---|---|---|---|
| BE | 1000915 | A | * | 5/1989 |
| DE | 102005028508 | | * | 1/2007 |
| GB | 2250032 | A | * | 5/1992 |
| GB | 2276557 | A | * | 10/1994 |
| JP | 2004329419 | A | * | 11/2004 |

* cited by examiner

*Primary Examiner* — Stephen F Gerrity
(74) *Attorney, Agent, or Firm* — Clement Cheng

(57) ABSTRACT

A water balloon fill and knot device has a housing, a hose connector disposed on the housing and also a connector base. A plurality of flanges or noses are disposed on the housing and flanges may include a flange sidewall and a flange bottom wall. A stem has a water channel formed through the stem terminating at a stem opening. The plurality of noses can be two noses placed at 120° from each other or three noses placed at 120° from each other. A ball pivot valve formed on the stem is ball shaped and forms a ball pivot face that pivots relative to a housing pivot lower face. A ball cap fits over the ball pivot valve, and the ball cap has a ball cap lower surface forming a ball cap face. The ball cap face is spherical in profile.

19 Claims, 11 Drawing Sheets

WATER BALLOON TOOL

This application is a continuation in part of and claims priority from inventor Chialeh Wang's Water Balloon Fill and Knot Device having U.S. patent application Ser. No. 12/537,487 filed Aug. 7, 2009, the disclosure of which is incorporated herein by reference.

DISCUSSION OF RELATED ART

Water balloons are a fun backyard summer activity. A wide variety of group games can be played with water balloons. Unfortunately, filling tying the knots on the water balloons can be stressful for the hands.

To make tying easier, a variety of devices such as one shown in U.S. Pat. No. 5,568,950 to Herren issued Oct. 29, 1996 the disclosure of which is incorporated herein by reference provides a base for attaching to a human hand by sliding over a finger. A U-shaped cantilever provides a retaining edge for retaining a loop of balloon material to assist in tying. A different device shown in U.S. Pat. No. 5,882,051 to Dreger issued Mar. 16, 1999 provides for a unitary construction handheld device for tying an inflated balloon. A ring-shaped device having notches and indents and protrusions assists in knot tying. Other balloon tying methods include one shown in U.S. Pat. No. 6,082,785 to Morgan issued Jul. 4, 2000 which provides a slotted dowel having a hole for sliding the neck of a balloon into the slot. The slotted dowel holds the opening of the balloon so that a user can wrap the balloon around the dowel and pull the knot over the opening. Yet another handheld balloon tier is shown in U.S. Pat. No. 6,902,212 issued Jun. 7, 2005 four inventor Mize. The Mize apparatus has a pair of prongs that protrude from a hand grip. The user can pull the balloon around the pair of prongs for easier tying. To assist in filling water balloons, a wide variety of devices such as one shown in U.S. Pat. No. 5,439,199 to Briggs issued Aug. 8, 1995 provides for a valve that is pushbutton activated and having a fluid aperture for filling.

Slotted openings are also used for assistance in knot tying, such as that shown in U.S. Pat. No. 3,630,555 issued Dec. 28, 1971 for inventor Newlin, the disclosure of which is incorporated herein by reference, who discloses a knot tying device having a concave portion formed next to a slot. The Newlin reference has a handle with a mandrel opposite the slot end for other operations. Angelico in U.S. Pat. No. 5,611,578 issued Mar. 18, 1997 provides a tool for tying knots in balloons, the disclosure of which is incorporated herein by reference. Angelico shows a tool that has opposing tapered ends and each and has a recessed area in the top surface that operates with a receiving slit for holding a balloon neck.

Double slot configurations have also been used. In Muma U.S. Pat. No. 5,039,142 issued Aug. 13, 1991 a tool for tying knots in balloons is disclosed, the disclosure of which is incorporated herein by reference. The knot tying tool has a neck integrally formed with a body and has a pair of slots for making a loop for tying a balloon. A notched balloon slot is shown in U.S. Pat. No. 5,314,217 issued to Place May 24, 1994, the disclosure of which is incorporated herein by reference. A bevel on the balloon notch as shown in U.S. Pat. No. 7,549,683 to Sikorcin issued Jun. 23, 2009 provides a retainer for the balloon neck portion, the disclosure of which is incorporated herein by reference. A bevel is an improvement on the scoop of Muma in providing a more positive retaining grip on the balloon without neck pinch.

SUMMARY OF THE INVENTION

A water balloon fill and knot device has a housing, a hose connector disposed on the housing and also a connector base.

A plurality of flanges disposed on the housing further include a flange sidewall and a flange bottom wall. A stem has a water channel formed through the stem terminating at a stem opening. The plurality of flanges can be two flanges placed at 120° from each other or three flanges placed at 120° from each other. A ball pivot valve formed on the stem is ball shaped and forms a ball pivot face that pivots relative to a housing pivot lower face. A ball cap fits over the ball pivot valve, and the ball cap has a ball cap lower surface forming a ball cap face. The ball cap face is spherical in profile.

A ball cap seal is oriented at a top opening of the water channel, and the ball cap seal has a top surface forming the connector base. A drive indent is formed on the ball cap, and can be hexagonal for receiving a hexagonal drive hand tool, such as a hexagonal screwdriver. An intermediate swivel coupler has a hose connector thread on an inside surface. The ball pivot has a sweep angle such that alignment of the water channel provides an on position and an off position.

When the sweep angle is oriented vertically, the water channel is aligned with the ball cap seal allowing water to pass through the stem, and when the sweep angle is oriented non-vertically, the water channel is out of alignment with the ball cap seal, preventing water from passing through the stem. Optionally, a T connector has a connector inlet and a connector outlet, and also a connector filler. The T connector further includes a clamp for securing to furniture. In actual usage, multiple T connectors can be chained together for supply from a single outlet. A water balloon box optionally includes a plurality of box scored openings received on scored opening prongs. The scored opening prongs vertically protrude from the T connector. A user may press and thus place a balloon box on the scored opening prongs that protrude from the T connector.

BRIEF DESCRIPTION OF THE DRAWINGS

FIG. 18 is a diagram of different animals that the nose can be styled as.

The drawings are not necessarily to scale. The following call out list of elements may assist in identifying the elements of the drawings:

Housing 10

Hose Connector 20

Connector Base 22
Ball Cap 24
Ball Cap Seal 26
Drive Indent 28
Lower Ball Cap Face 29
Flange 30
Flange Sidewall 32
Flange Bottom Wall 34
Stem 40
Stem Opening 42
Prong 41
Nose 43
Water Channel 44
Slot 45
Tip 47
Scoop 48
Ball Pivot 50
Water Balloon 51
Ball Pivot Face 52
Neck 53
Housing Pivot Lower Face 54
Sweep Angle 56
T Connector 110
Termination Valve 111
Connector Inlet 112
Connector Outlet 113
Connector Clamp 120
Connector Filler Valve 130
Connector Filler Thread 135
Junction Area 140
Scored Opening Prong 188
Water Balloon Box 210
Box Scored Opening 212

DETAILED DESCRIPTION OF THE PREFERRED EMBODIMENTS

Figure 1:
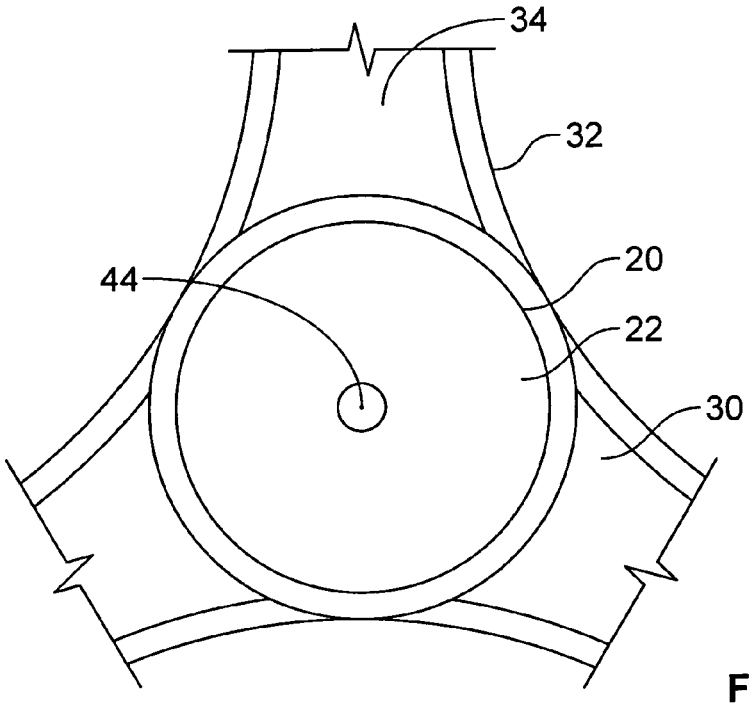
FIG. 1 is a top view of the first embodiment.

FIG. 1 shows a top view of the first embodiment. The first embodiment includes a housing 10 which includes a hose connector 20, a connector base 22, a flange 30, a flange sidewall 32, a flange bottom wall 34, a stem 40, a stem opening 42 and a water channel 44. The housing is preferably made of plastic, but can also be made of metal.

Figure 2:
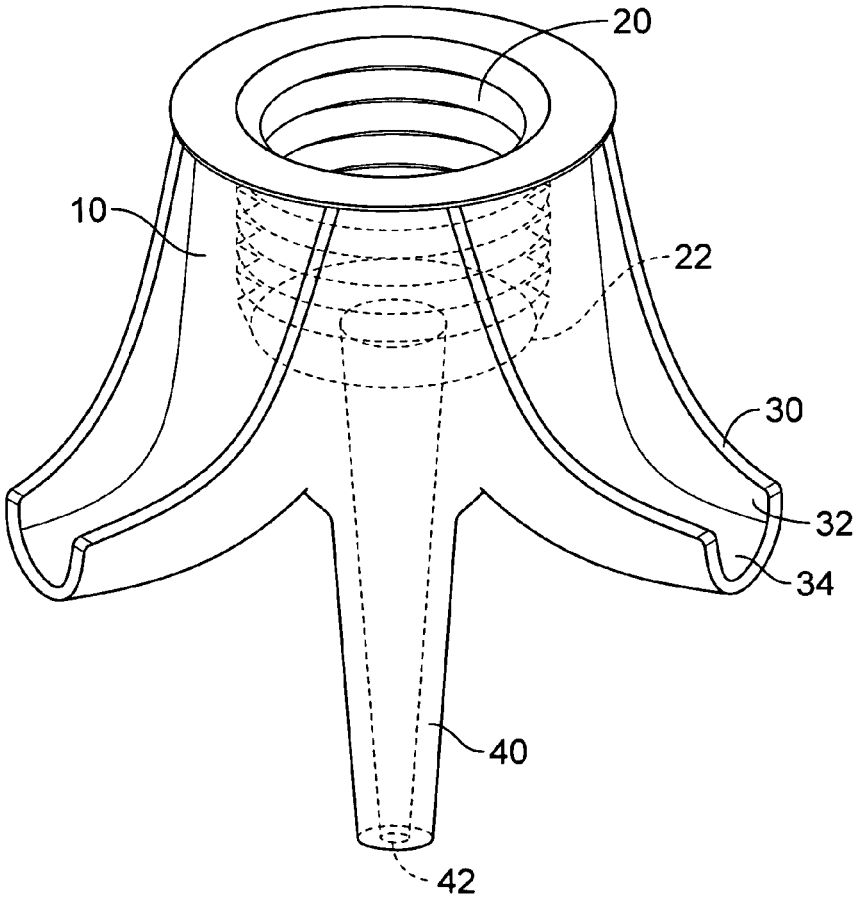
FIG. 2 is a perspective view of the first embodiment.

The housing 10 is preferably formed as a single piece of plastic having an integrally formed hose connector 20 which is formed as a threaded connector for connecting to external threading of a garden hose. The hose connector 20 terminates at a connector base 22 which directs water through a water channel 44 passing through stem 40 and exiting through stem opening 42. In use, a water balloon is filled on stem 40. The stem opening 42 passes water through and into the water balloon. The flange 30 is placed three times in a pinwheel orientation equidistant spaced at 120° from each other. As seen in FIG. 1, a top flange is flanked by a left flange and a right flange. Each flange 30 has a vertical flange sidewall 32 and a flange bottom wall 34 as seen in FIG. 2. The profile can be made as a U-shaped scoop which conforms to the shape of a finger. Preferably, the flanges are integrally formed with the housing 10. The flange sidewalls preferably begin at the top of hose connector 20.

Figure 3:
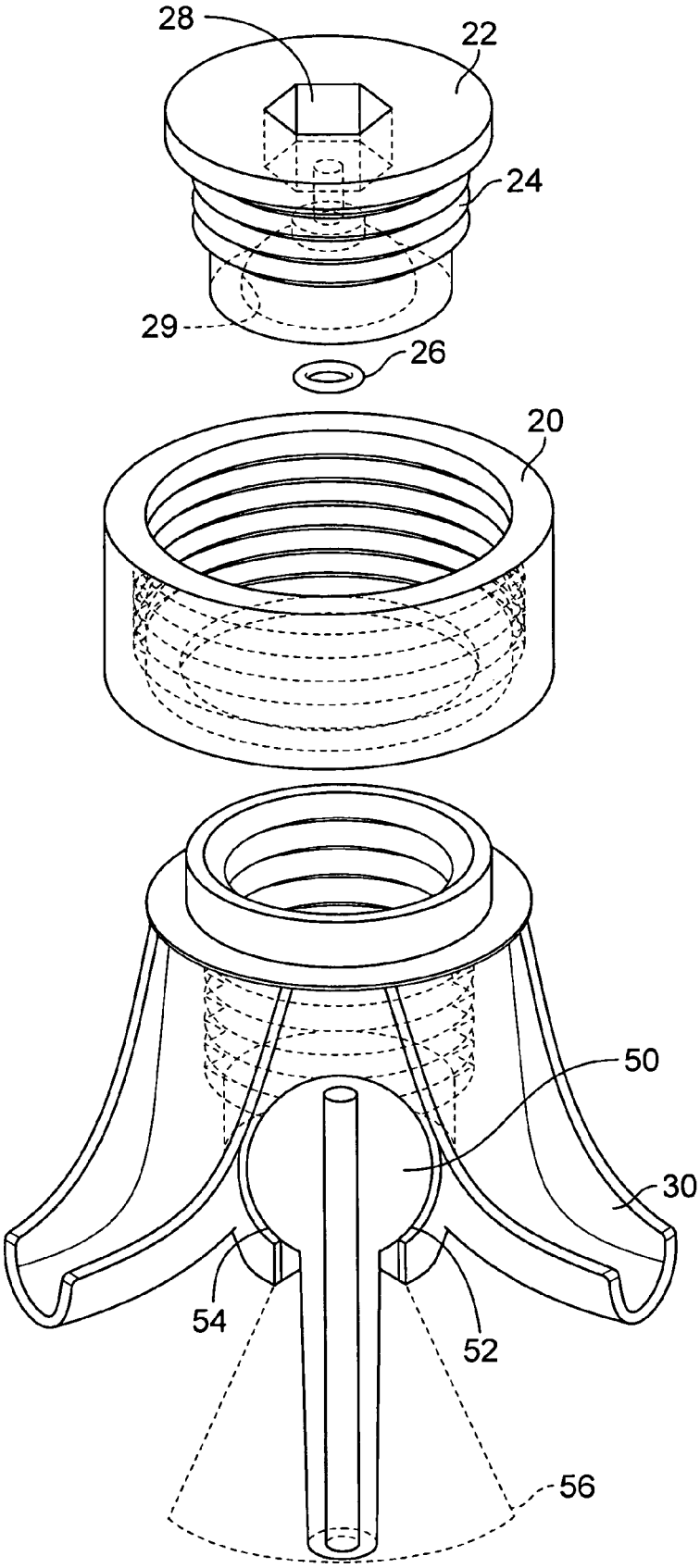
FIG. 3 is an exploded view of the second embodiment.

An improved version of the first embodiment of FIGS. 1, 2 is shown as an exploded view of the second embodiment in FIG. 3. The second embodiment includes a cap securing a ball pivot valve into the housing 10. The second embodiment has a housing that is made of two sections. The housing has a housing upper section which is the hose connector 20. The housing has a lower section which is the water outlet section holding the ball pivot 50. The lower section is the ball pivot section of the housing 10. A ball cap 24 has a lower ball cap face 29 which is spherical in profile. A ball cap seal 26 is oriented at a top opening where a drive indent 28 is formed on the ball cap 24. The ball cap 24 has a top surface which is the connector base 22. An intermediate swivel coupler forms the hose connector 20. The swivel coupler allows swiveling relative to the lower portion of the housing 10. The swivel coupler has an interior lower circumferential narrow section that can be retained against a vertical wall formed at the wide portion of connector base 22 over the ball cap 24. Thus, the swivel coupler can be secured by the ball cap 24. The swivel coupler interior lower circumferential narrow section fits against a vertical wall and shoulder of the lower housing. The shoulder is a flat portion that abuts the swivel coupler interior lower circumferential narrow section. The vertical wall protrudes upwardly into the swivel coupler. Typically, as is commonly known in the art, a hose o-ring not shown in the drawings is added between the hose connector and the garden hose to provide a watertight seal while allowing 360° rotation of the parts of the device.

A ball pivot 50 is in seal between a ball cap face 29 at a top side and at a bottom side in seal between a ball pivot face 52 which makes with a housing pivot lower face 54. The ball pivot 50 has a sweep angle 56 such that alignment of the water channel 44 vertically allows water to pass through the ball 24, through the middle of the ball cap seal 26 and through the water channel 44. When the water channel 44 is not aligned, and when a user does not wish to fill a balloon, or after a user is done filling a balloon, the user moves the stem 40 to an angle that is not vertical which is an off position. The user then selects one of the flanges 30 which is more convenient due to its location, and wraps the neck of the balloon around the flange sidewall 32. The user then tucks the balloon opening along the flange bottom wall 34 with a finger to complete the knot.

Figure 4:
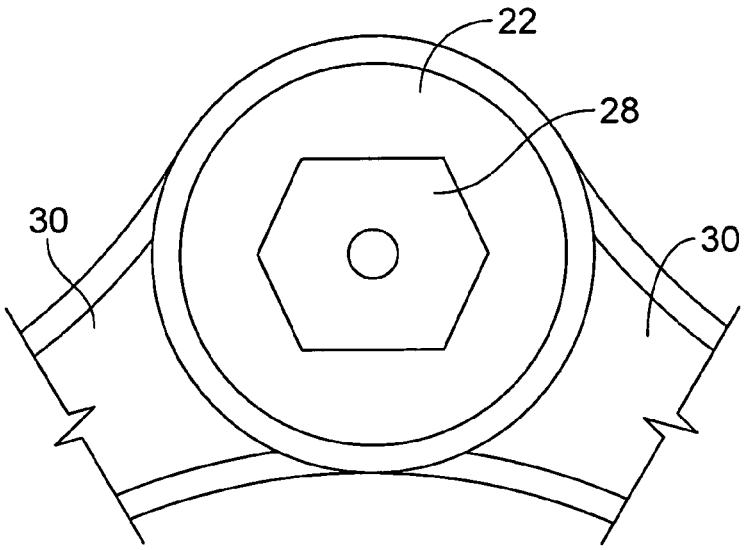
FIG. 4 is a top view of a two flange embodiment.

Although a three flange 30 embodiment is preferred, a double flange embodiment as shown in FIG. 4 is also possible. The pair of flange sidewall is at least 0.5 inch apart in both embodiments. The flange is preferably U shaped in a profile of a half circle or scoop shaped. The exterior surface of the flange is preferably smooth.

Figure 5:
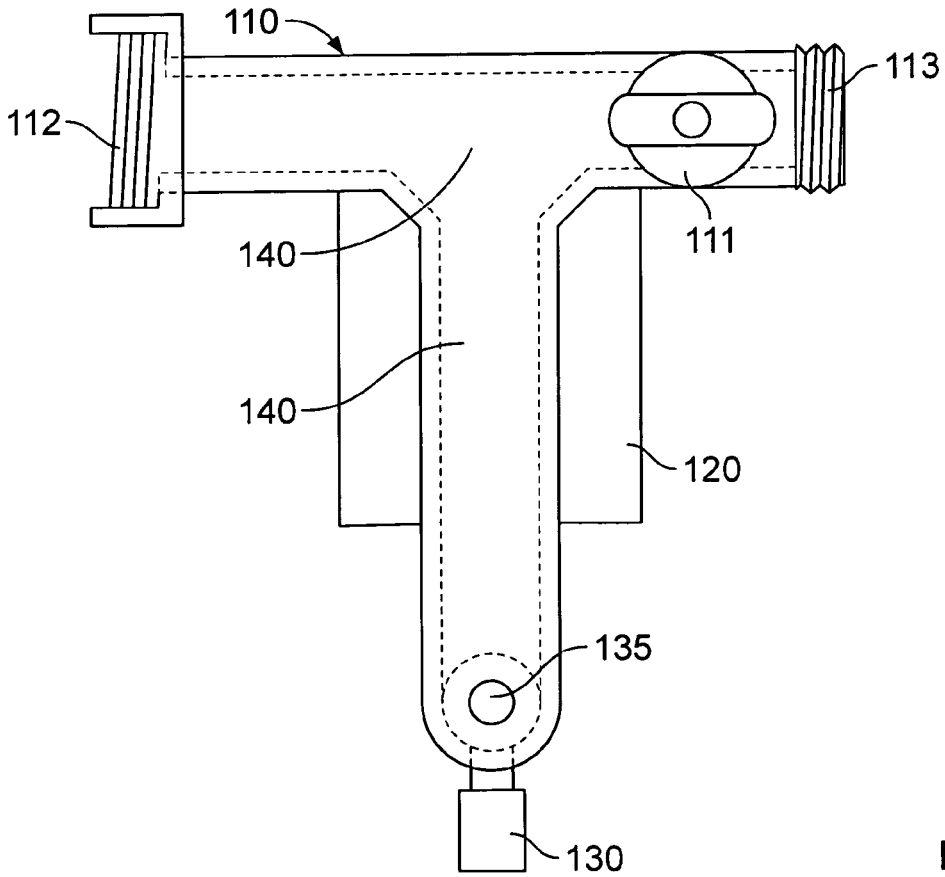
FIG. 5 is a top view of a connector clamp.
Figure 7:
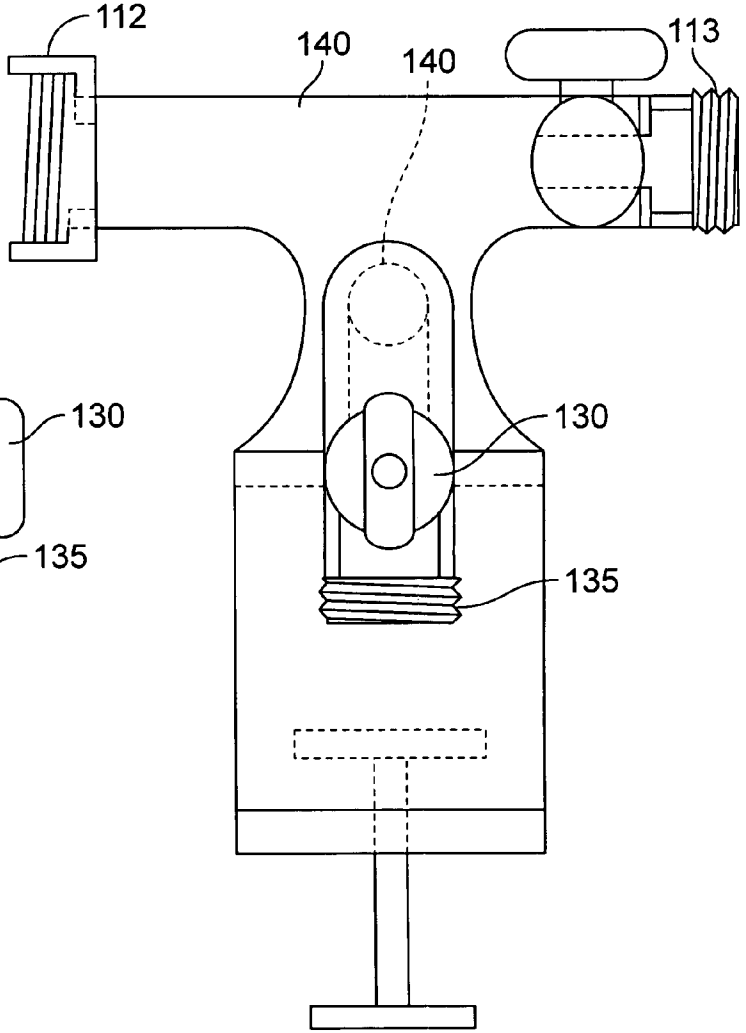
FIG. 7 is a front view of a connector clamp.
Figure 6:
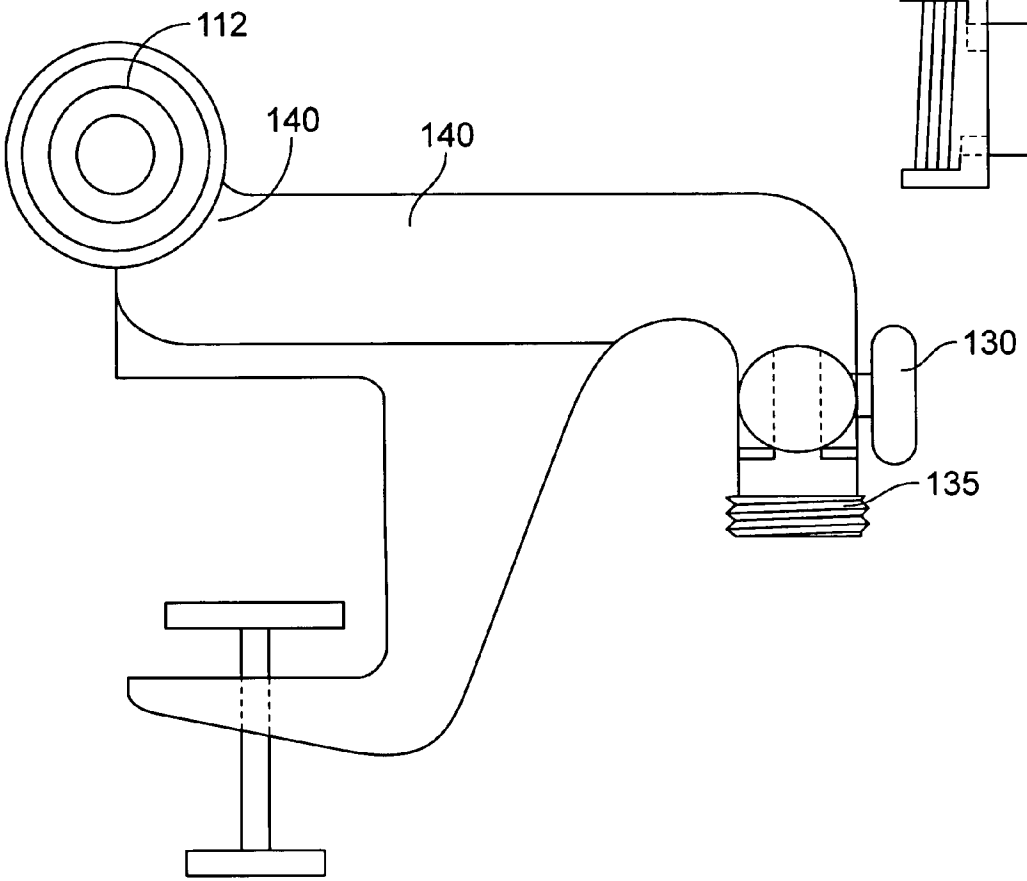
FIG. 6 is a side view of a connector clamp.

As seen in FIGS. 5-7 a T Connector 110 can be used in conjunction with the present invention as an optional improvement. The T Connector can be made of plastic or metal. A connector inlet 112 is connected to a connector outlet 113 so that the connector 110 can be chained in a series, such as clamped along a picnic bench. The connector clamp 120 allows clamping of the connector to furniture such as a picnic bench. The connector clamp 120 is a typical clamp that can be operated by hand. The connector clamp may have a handle for rotating. A connector filler thread 135 allows attachment to the hose connector 20 for filling water balloons. Optionally, a connector filler valve 130 provides additional flow control. A junction area 140 joins water flow from a connector inlet 112 and the connector outlet 113 with an outlet connector filler thread 135. A termination valve 111 can be used for controlling flow to the connector outlet 113. The termination valve 111 has an on and off position similar to the connector filler valve 130.

Figure 8:
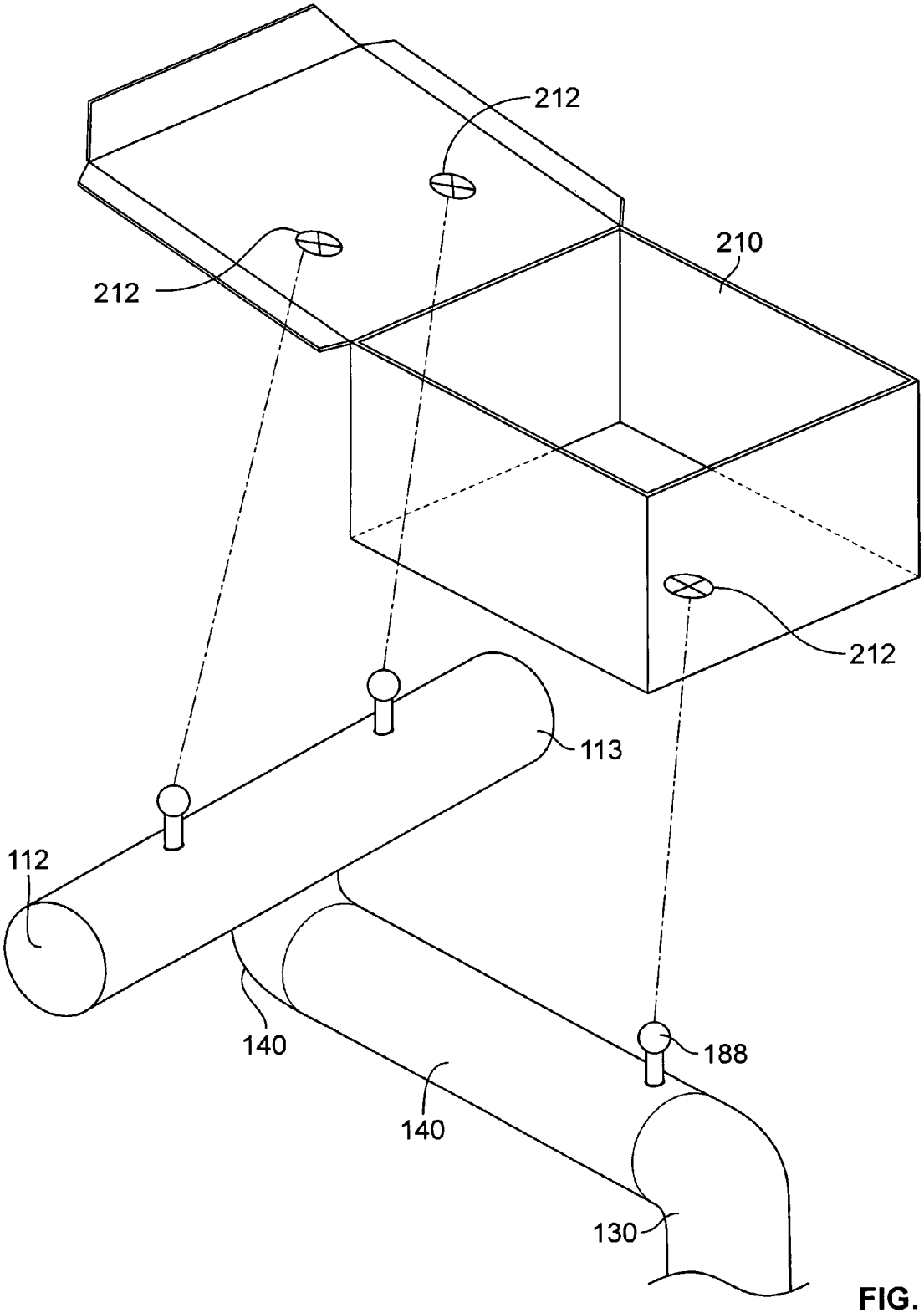
FIG. 8 is a diagram exploded view of a box for water balloons attaching to the connector clamp.
Figure 9:
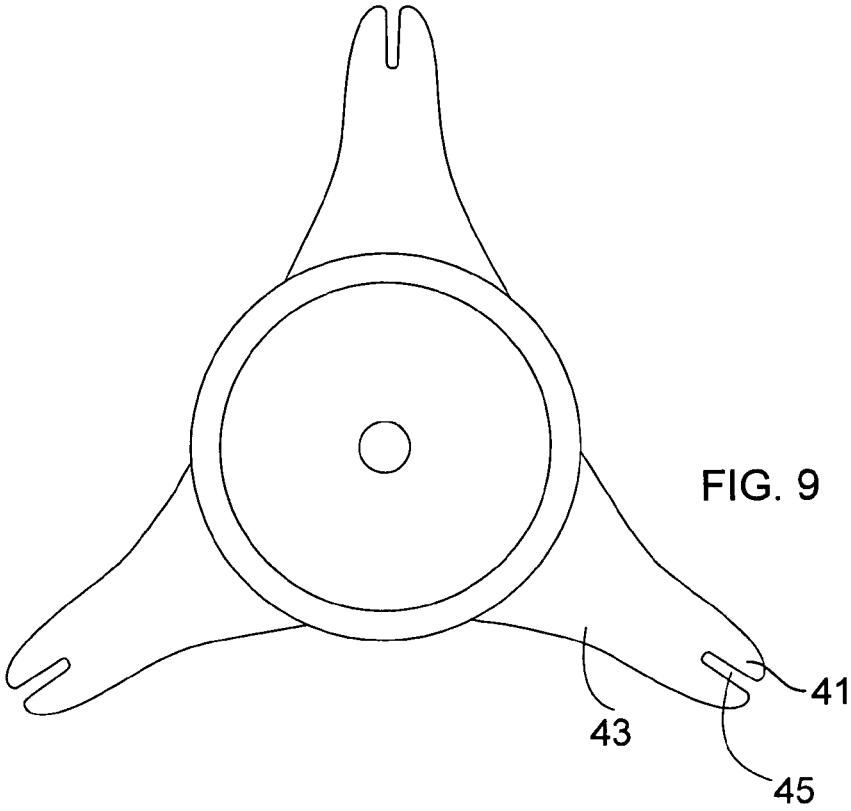
FIG. 9 is a top view of the nose embodiment.
Figure 10:
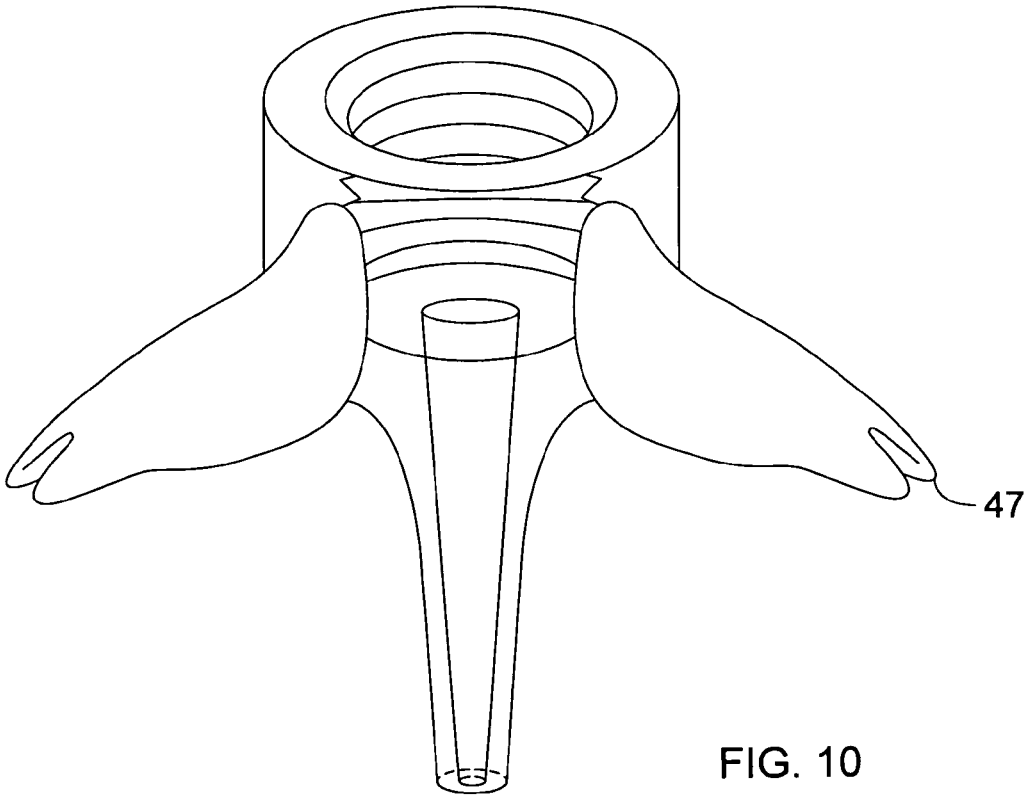
FIG. 10 is a see through perspective view of the nose embodiment.

As seen in FIG. 8, which is a diagram view, a scored opening prong 188 receives a box scored opening 212 of a water balloon box 210. The water balloon box 210 is a commercial packaging container for the water balloons. Water balloons can be sold in bulk of quantities 500, 1000 and the like. The box scored opening is preferably a scored circular opening having scored tabs that are quartered to allow the scored opening prongs 188 to protrude through the box. A first scored opening prong 188 passes through the bottom of the water balloon box 210 and a pair of top box scored openings 212 fit over the second scored opening prong 188 and the third scored opening prong 188. The first scored opening prong is extending from the area above the connector filler thread near the connector filler valve. The second scored opening prong and the third scored opening prong extend from the top of the junction 140. The prongs can be welded or integrally cast with the junction or can be threaded to the junction.

The box has a lid that flips open. The water balloon box can package the water balloons as well as the water balloon fill and knot device. A pair of scored openings are disposed on the lid of the box, and another scored opening is disposed on the base of the box. The pair of scored openings on the lid engage with the prongs when the box lid is in the open position. The box can be made of cardboard, or card stock. The water balloons can be loose or held in a plastic bag, and are typically thin so that they burst upon impact and do not cause harm to the participants.

In the nose embodiment of the present invention as seen in FIGS. 9-17, the nose 43 provides a structure for receiving a neck 53 of a balloon 51. The nose structure includes a pair of prongs 41, a slot 45 and a pair of tips 47 that terminate the pair of prongs. The slot is disposed with a scoop 48.

The pair of tips protrude from the nose in a downward direction such that a bend is formed in the nose. A plurality of nose protrusions can extend from the main body. The prongs 41 also preferably curve downward to form the bend. The slot 45 is similarly curved downward on an underside.

The scoop 48 is preferably a shallow one like that described in the Morgan reference, incorporated herein by reference. The scoop differs from the bevel of the Sikorcin reference in that the present invention side walls of the slot area touch, but do not pinch the neck portion of the balloon because the slots have a smooth curved profile and appropriate sizing to retain the neck portion in the slot area. This allows a user to remove the neck from the slot easily if there is a need to extract the neck portion, such as if a balloon pops during the knot tying process. The scoop 48 is also preferably curved downward in an arc shaped profile.

Figure 11:
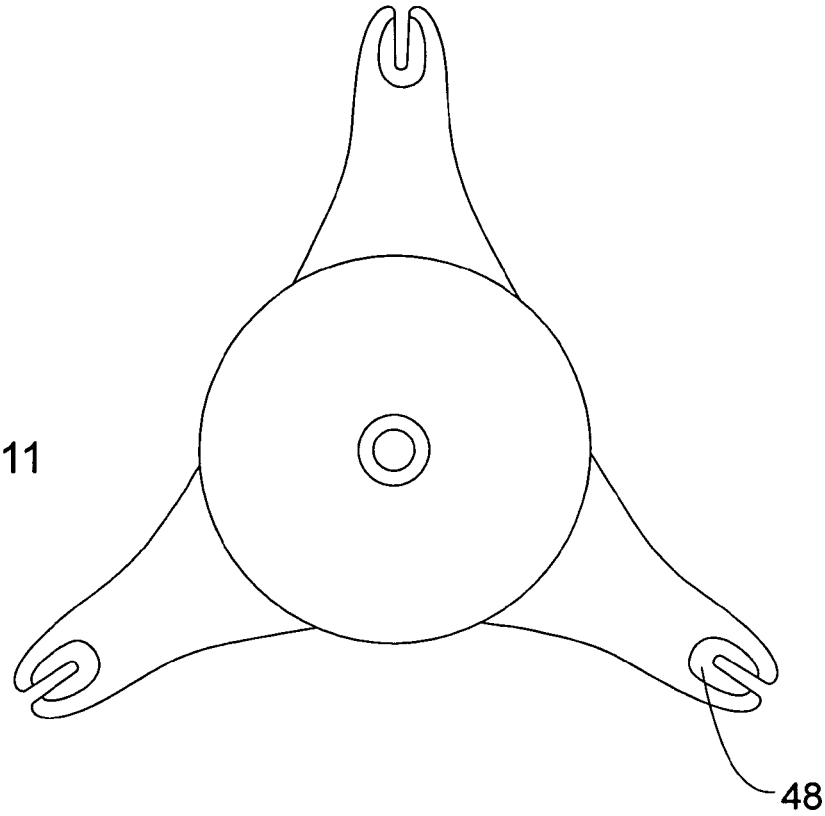
FIG. 11 is a bottom view of the nose embodiment.
Figure 12:
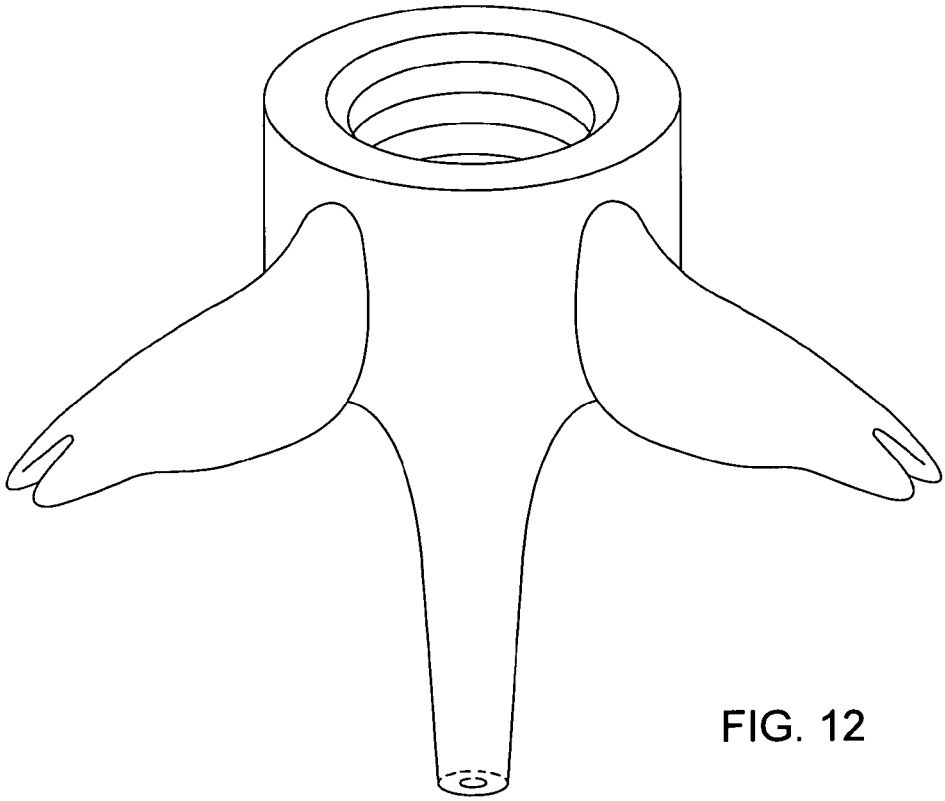
FIG. 12 is a perspective view of the nose embodiment.
Figure 13:
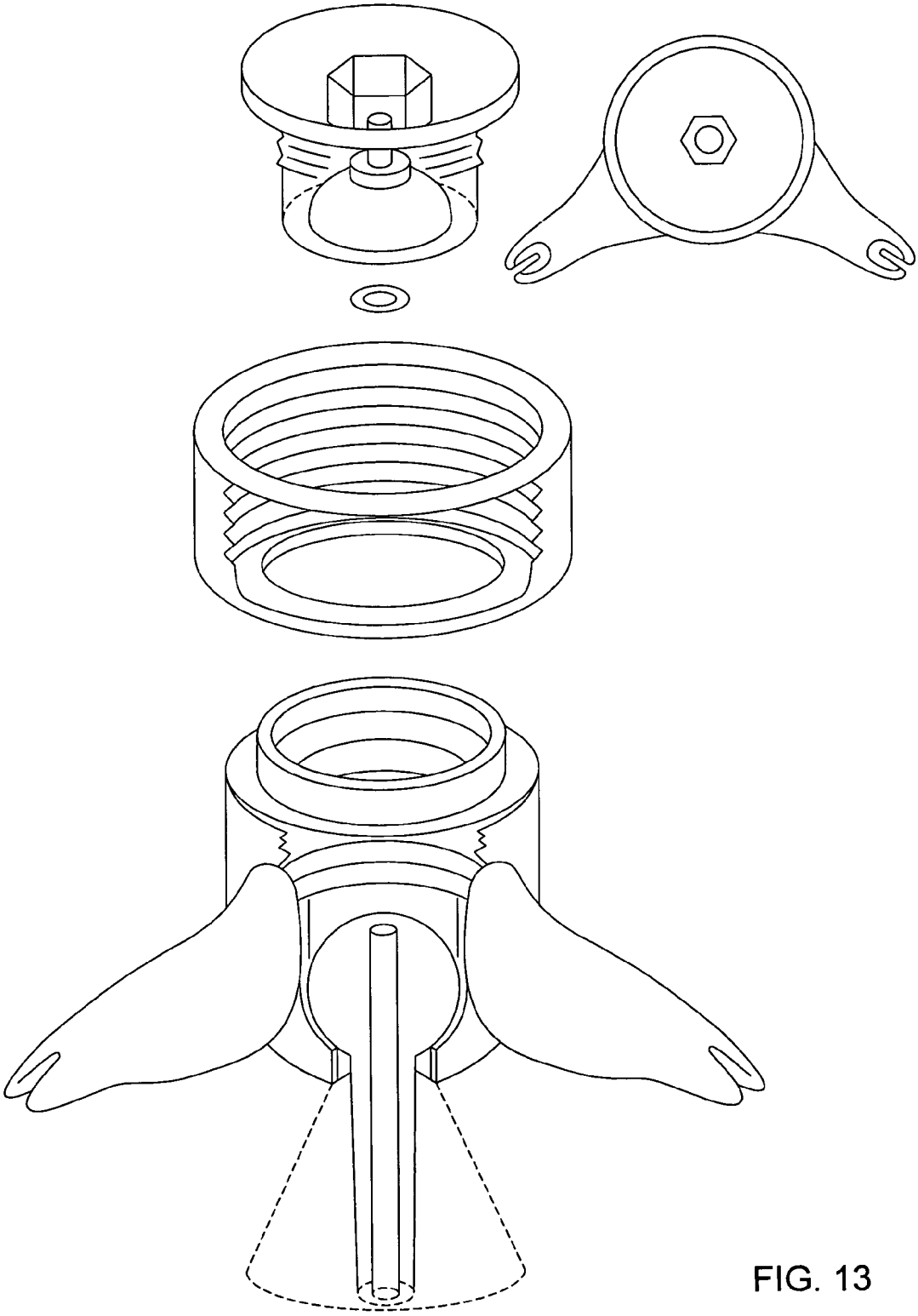
FIG. 13 is an exploded view of the nose embodiment.

If a scoop is disposed as shown in FIG. 11, the scoop begins at an area above the slot at above a notch area. The scoop is formed on the left and right side of the notch area such that the centroid of the scoop is approximately at the notch area. The scoop does not extend to the tip, and a periphery of the prongs 41 is shown where the scoop is not indented. The scoop is formed as a shallow indent on the bottom of the pair of prongs which extend from the nose.

Figure 14:
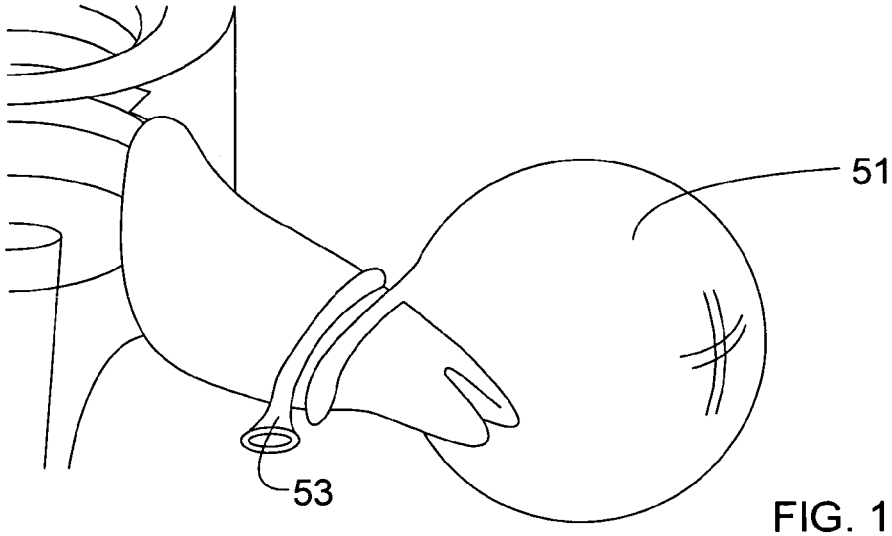
FIG. 14 is a step one knot tying diagram of the nose embodiment.
Figure 15:
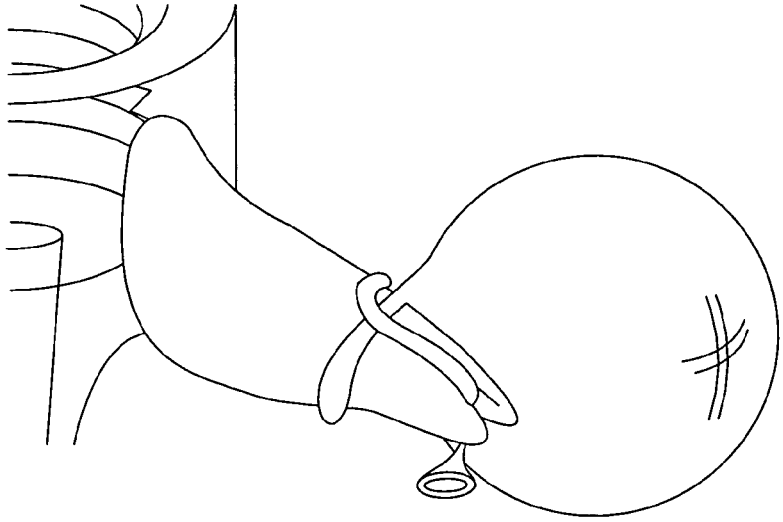
FIG. 15 is a step two knot tying diagram of the nose embodiment.
Figure 16:
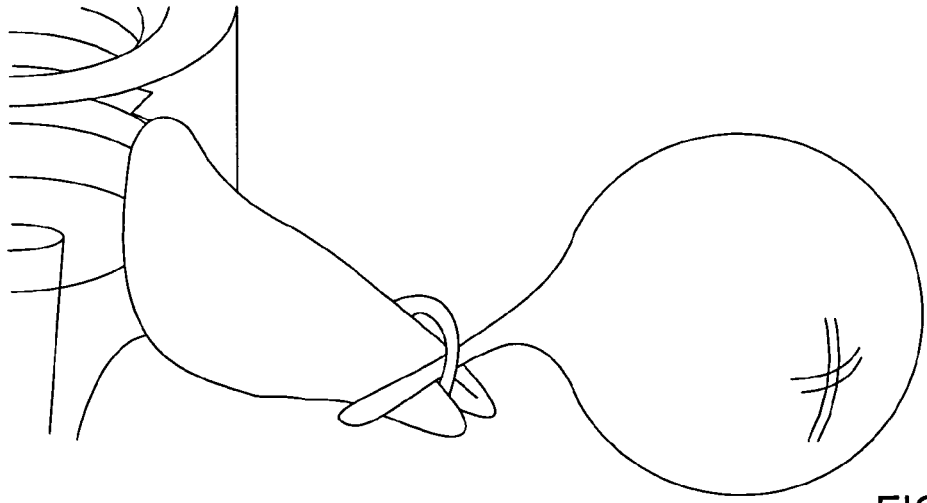
FIG. 16 is a step three knot tying diagram of the nose embodiment.

A possible use of the nose is shown in the drawings FIGS. 14-16. In the first step, a user grasps a water balloon or air inflated balloon and wraps the neck around the nose to form a loop. In the second step, the neck is placed in the slot which holds the neck. The user pulls on the balloon and the neck being retained in the slot passes through the loop when the bloom is pulled away. The passage of the neck through the slot forms an overhand knot that seals the balloon.

Figure 17:
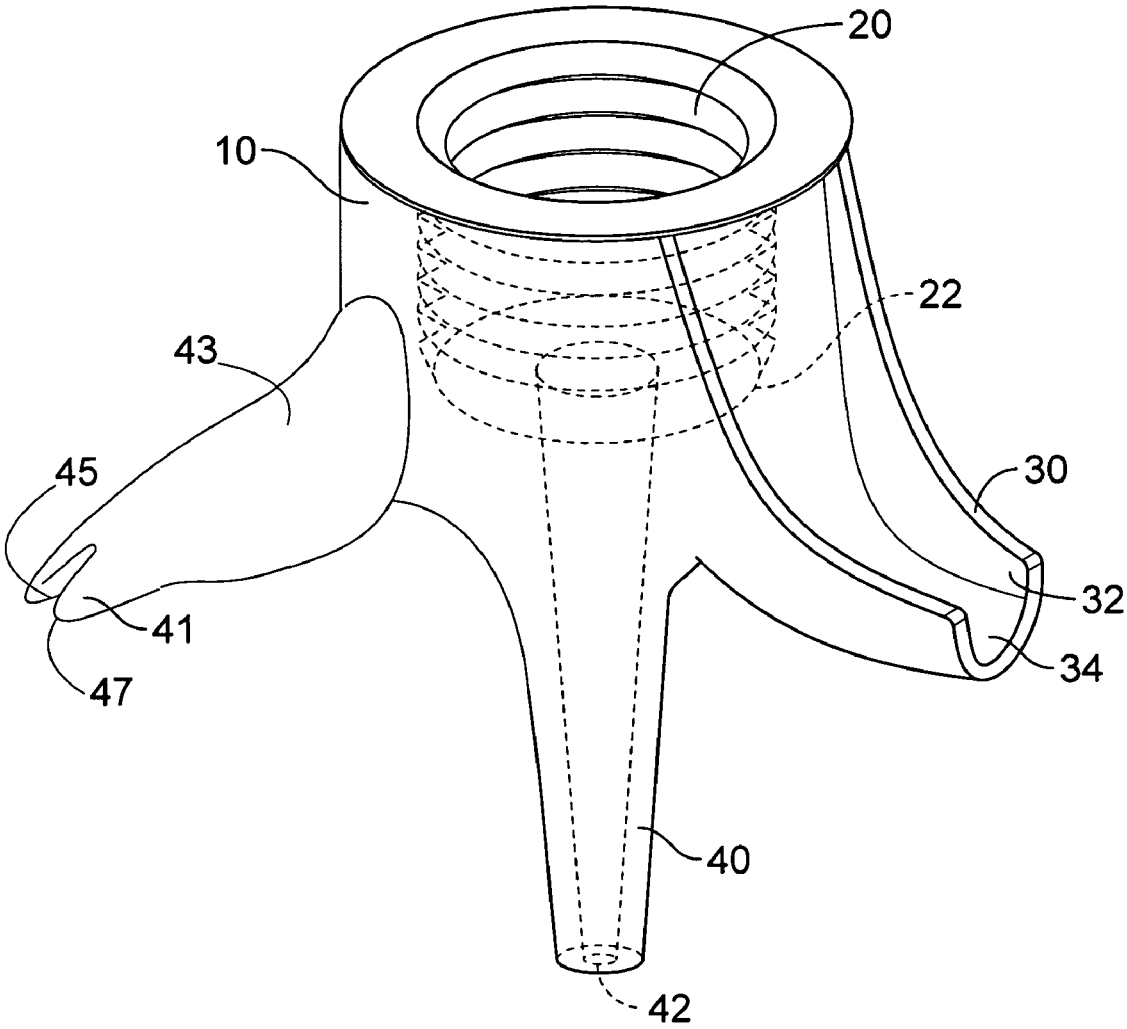
FIG. 17 is a perspective view of the combination mode to provide a comparison between the nose embodiment and the first embodiment of the invention.

A combined structure can also be used showing the nose with the flange. FIG. 17 shows a combined first embodiment of the present invention with a nose embodiment of the present invention. To provide a comparison of the various embodiments of the present invention, the nose is on the left and the flange is on the right. Of course, it is also possible to make the combined embodiment which has a flange for those users who are accustomed to using the flange and a nose with a slot for those users who are accustomed to using a slot.

Figure 18:
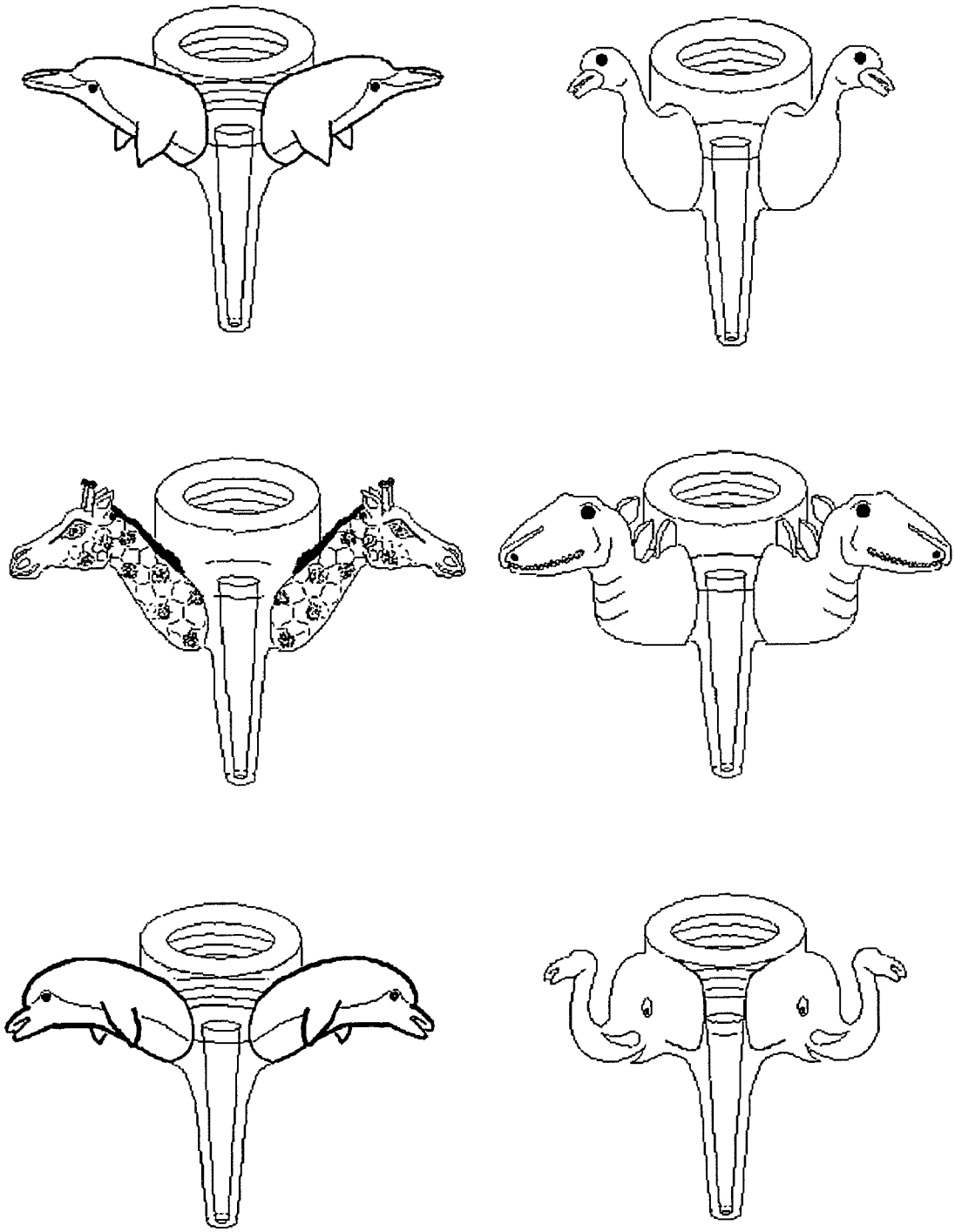

The nose can represent an actual nose of an animal, if the nose represents an animal and is in a theme shape such as in FIG. 18. Various animals include dolphin, duck, giraffe, dinosaur, porpoise, and elephant. In the duck embodiment, the duck bill can serve as the slot. Also, in the porpoise embodiment, the mouth can serve as the slot. The slot can also be disposed through a nose of an animal.

The embodiment with the noses can also be used with the clamp filler device, and also with the flange embodiment.

Although the invention has been disclosed in detail with reference only to the preferred embodiments, those skilled in the art will appreciate that various other embodiments can be provided without departing from the scope of the invention. Accordingly, the invention is defined only by the claims set forth below.

The invention claimed is:

1. A water balloon fill and knot device comprising:

a. a housing;

b. a hose connector disposed on the housing and further comprising a connector base;

c. a plurality of noses disposed on the housing, wherein the plurality of noses further comprise a pair of prongs and a scoop, wherein the pair of prongs has an underside, wherein the scoop is disposed on the underside of the pair of prongs, wherein the pair of prongs have a spaced apart opening formed as a slot; and d. a stem, wherein the stem further comprises a water channel formed through the stem terminating at a stem opening.

2. The water balloon fill and knot device of claim 1, wherein the plurality of noses consists of two noses placed at 120° from each other.

3. The water balloon fill and knot device of claim 1, wherein the plurality of noses consists of three noses placed at 120° from each other.

4. The water balloon fill and knot device of claim 1, further comprising:

a. a ball pivot valve formed on the stem, wherein the ball pivot valve is ball shaped and forms a ball pivot face that pivots relative to a housing pivot lower face;

b. a ball cap fitting over the ball pivot valve, wherein the ball cap has a ball cap lower surface forming a ball cap face, wherein the ball cap face is spherical in profile.

5. The water balloon fill and knot device of claim 4, wherein the plurality of noses consists of two flanges placed at 120° from each other.

6. The water balloon fill and knot device of claim 4, wherein the plurality of noses consists of three flanges placed at 120° from each other.

7. The water balloon fill and knot device of claim 4, further comprising:

a. a ball cap seal oriented at a top opening of the water channel, wherein the ball cap seal has a top surface forming the connector base;

b. a drive indent formed on the ball cap; and c. an intermediate swivel coupler having hose connector thread on an inside surface, wherein the ball pivot has a sweep angle such that alignment of the water channel provides an on position and an off position.

8. The water balloon fill and knot device of claim 7, wherein the plurality of noses consists of two flanges placed at 120° from each other.

9. The water balloon fill and knot device of claim 7, wherein the plurality of noses consists of three flanges placed at 120° from each other.

10. The water balloon fill and knot device of claim 7, wherein when the sweep angle is oriented vertically, the water channel is aligned with the ball cap seal allowing water to pass through the stem, and wherein when the sweep angle is oriented non-vertically, the water channel is out of alignment with the ball cap seal, preventing water from passing through the stem.

11. The water balloon fill and knot device of claim 10, wherein the plurality of noses consists of two flanges placed at 120° from each other.

12. The water balloon fill and knot device of claim 10, wherein the plurality of noses consists of three flanges placed at 120° from each other.

13. The water balloon fill and knot device of claim 7, further comprising: a T connector having a connector inlet and a connector outlet, and also having a connector filler, wherein the T connector further comprises a clamp for securing to furniture.

14. The water balloon fill and knot device of claim 13, wherein the plurality of noses consists of two flanges placed at 120° from each other.

15. The water balloon fill and knot device of claim 13, wherein the plurality of noses consists of three flanges placed at 120° from each other.

16. The water balloon fill and knot device of claim 13, further comprising: a water balloon box having a plurality of box scored openings received on scored opening prongs, wherein scored opening prongs vertically protrude from the T connector.

17. The water balloon fill and knot device of claim 16, wherein the plurality of noses consists of two flanges placed at 120° from each other.

18. The water balloon fill and knot device of claim 16, wherein the plurality of noses consists of three flanges placed at 120° from each other.

19. The water balloon fill and knot device of claim 18, further comprising water balloons in the water balloon box.

* * * * *